US009950228B1

(12) United States Patent
Steele

(10) Patent No.: US 9,950,228 B1
(45) Date of Patent: Apr. 24, 2018

(54) MULTI GOLF METAL SAND BUNKER SPRING RAKE

(71) Applicant: Joseph Lo'Vel Steele, Philadelphia, PA (US)

(72) Inventor: Joseph Lo'Vel Steele, Philadelphia, PA (US)

(73) Assignee: Joseph Lo'Vel Steele, Philadelphia, PA (US)

( * ) Notice: Subject to any disclaimer, the term of this patent is extended or adjusted under 35 U.S.C. 154(b) by 177 days.

(21) Appl. No.: 14/999,130

(22) Filed: Mar. 31, 2016

(51) Int. Cl.
*A63B 57/50* (2015.01)

(52) U.S. Cl.
CPC ..... *A63B 57/50* (2015.10)

(58) Field of Classification Search
CPC ..... A63B 57/50; A01D 11/06; A01D 7/00; A01D 1/227
See application file for complete search history.

(56) References Cited

U.S. PATENT DOCUMENTS 1,014,404 A * 1/1912 May ..... A01D 7/00 15/79.1
1,151,584 A * 8/1915 Hart ..... A01D 11/06 56/400.06
3,210,111 A * 10/1965 Fallon ..... A63B 57/50 15/160
3,390,516 A * 7/1968 Burrows ..... A01D 7/00 56/400.19
4,122,570 A * 10/1978 Otken ..... A01B 1/227 172/375
4,843,667 A * 7/1989 Hanly, Sr. ..... A01B 1/20 56/400.06
5,042,812 A * 8/1991 Tillman ..... A63B 55/10 172/713
5,179,825 A * 1/1993 Griffiths ..... A01D 7/00 56/400.05
5,185,992 A * 2/1993 Garcia ..... A01B 1/227 172/375
5,303,536 A * 4/1994 Tolliver ..... A01D 7/10 56/400.12
D352,874 S * 11/1994 Garcia ..... D8/13
5,461,849 A * 10/1995 Allen ..... A01D 11/06 172/375
D372,128 S * 7/1996 Beach ..... D4/116
5,605,034 A * 2/1997 South ..... A63B 57/00 56/400.07
5,927,057 A * 7/1999 Hueber ..... A63B 57/50 56/400.04
6,761,021 B1 * 7/2004 Snyder ..... A01D 7/04 56/400.04
6,848,247 B2 * 2/2005 Rozen ..... A01D 7/06 56/400.04
8,322,764 B2 * 12/2012 Miller ..... B25G 1/04 15/145

(Continued)

*Primary Examiner* — Joshua T Kennedy

(57) ABSTRACT

A tool for golf course's sand bunkers that almost eliminate lines in the sand comprising a metal golf sand bunker spring rake having an elongated handle, a pair of metal tubular housings that are fastened to the handle configured to receive respective attachments, a protective shield plate assembly, a rubber cushion pad, and a sand bunker probe device. The attachments that can be connected to the tool include a roller attachment, a push tube assembly attachment, a plastic sand bunker rake attachment, and/or a drag brush.

5 Claims, 8 Drawing Sheets

(56) References Cited

U.S. PATENT DOCUMENTS

| | | | | |
|---|---|---|---|---|
| 2005/0056436 | A1* | 3/2005 | Lundh | A01B 1/24<br>172/371 |
| 2016/0207190 | A1* | 7/2016 | Balz | A46B 5/0095 |

* cited by examiner

MULTI GOLF METAL SAND BUNKER SPRING RAKE

FIELD OF INVENTION

The present invention relates to a golf course sand bunker rake. While working on a golf course, in a sand bunker raking sand, when using the rake in the sand, it loosens it up to give it a softer look. But it also leaves lines in the sand from the rake's teeth. The rake attachment has a plexglas protective shield-holding plate assembly, with drag brush and a rubber cushion pad attached behind the rake's teeth, the second attachment is a semi soft rolling pad, the third attachment is a harder rolling pad, the fourth attachment is a push tube assembly with drag brush attached and the fifth attachment is a plastic sand bunker rake. The rake assembly, the rollers, the push tube assembly and the plastic sand bunker rake attachments can be taken off the dual metal tubular housing on the handle, the handle also has a sand probe device inside, at the top of the handle.

BACKGROUND OF THE INVENTION

Complaint from golfers, telling us that the bunker rakes, leaves deep lines in the sand, especially around the bunker's sand slope edges. We, the workers, are helpless in this situation, we had to use a sand bunker rake and a roller separately, that makes each worker had to carry two pieces of equipment to every bunker. The present invention is to avoid more complaints from golfers. A few patent designs for raking sand bunkers as described in U.S. Pat. No. 1,151,584, U.S. Pat. No. 5,179,825, U.S. Pat. No. 3,210,111, U.S. Pat. No. 5,303,536, and U.S. Pat. No. 6,848,247 B2.

Another type of patent designs for raking sand bunkers are, combination rakes, as described in U.S. Pat. No. 5,605,034, U.S. Pat. No. 5,042,812 A and U.S. Pat. No. 3,390,516 A.

SUMMARY OF THE INVENTION

The present invention provides an apparatus for raking golf course's sand bunkers. This system accomplishes all of the ends described in U.S. Pat. No. 1,151,584, U.S. Pat. No. 5,179,825, U.S. Pat. No. 3,210,111, U.S. Pat. No. 5,303,536, and U.S. Pat. No. 6,848,247 B2. An added to other combination rakes described in U.S. Pat. No. 5,605,034, U.S. Pat. No. 5,042,812 A, and U.S. Pat. No. 3,390,516 A. First includes a metal spring rake attachment, with a plexiglas protective shield holding plate assembly, with drag brush attached behind the rake's teeth, it smooth the sand to almost eliminate lines in the sand. The rubber cushion pad is to muzzle the sound from the plexiglas by the rake's teeth and for the sand's slope edges of the bunkers. A second attachment is a roller, with a semi soft rolling pad, with five adjustable settings, while turning the rake on it back, the roller can smooth the bunker's sand sloped edges snowing a smoother and flatter sand surface with no lines. With five adjustable settings, to adjust the roller, just squeeze the buttons on each side of the metal tubular housing, and push down or pull up to the next hole that clicks. The third attachment is a harder rolling pad that compacts the sand sloped edges more tightly, with five adjustable settings, to adjust the roller, just squeeze the buttons on each side of the metal tubular housing, and push down or pull up to the next hole that clicks. The fourth attachment is a push tube assembly with drag brush attached, that push the sand up the bunker's slope edges, with five adjustable settings, the best setting for pushing sand up the sand slope is the last two holes that clicks. But for the drag brush attached to the push assembly, just take the assembly off, by squeezing the two buttons on the side of the metal tubular housing and twist very slightly left or right and pull it out, turn it around and attach it to the first two holes that clicks. To adjust the push tube assembly, just squeeze the buttons on each side of the metal tubular housing, and push down or pull up to the next hole that clicks. The fifth attachment is a plastic sand bunker rake, loosens up the sand and make lines, and the sixth is a sand probe device, to measure the sand on the bunker slopes to see if it needs more sand, to retrieve the sand bunker probe device go to the top of the handle, unscrew the screw and tilt the handle it will fall out. The roller attachments, the push tube assembly attachment and the plastic sand bunker rake attachment all can be taken off the rake handle. By squeezing the buttons on each side of the metal tubular housing, then very slightly turning left or right, and pull up until it comes out of its tubular housing, leaving the rake, in one of the metal tubular housing on the handle making it a normal golf metal sand bunker spring rake.

DETAILED DESCRIPTION OF THE PREFERRED EMBODIMENTS

Figure 1:
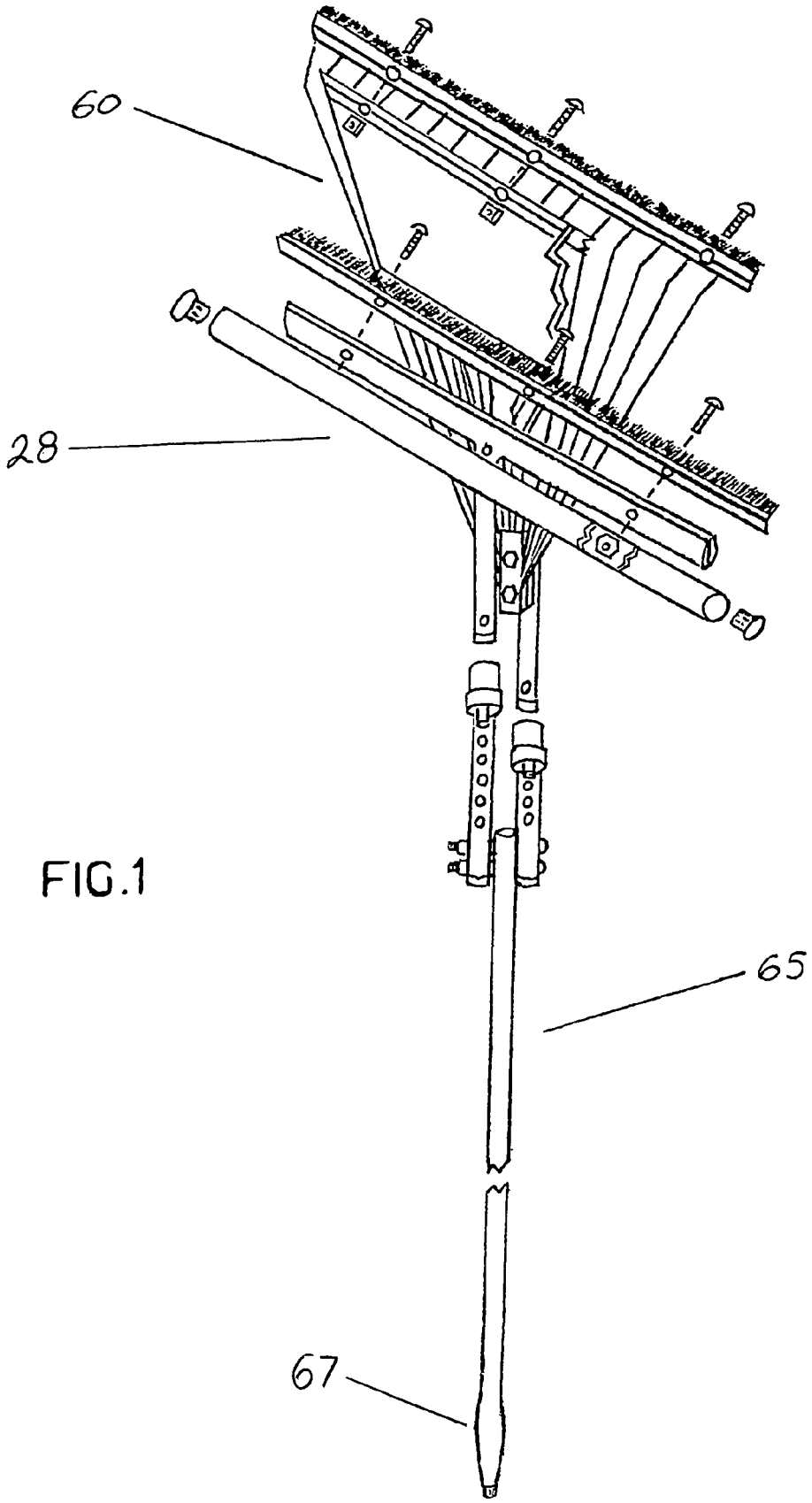
FIG. 1 is a diagram plan view of an attachment metal golf sand bunker spring rake which show the location of the components on the tool made in accordance with the invention.

Referring now to the drawing figures, wherein like reference numerals represent like parts throughout the several views.

Figure 2:
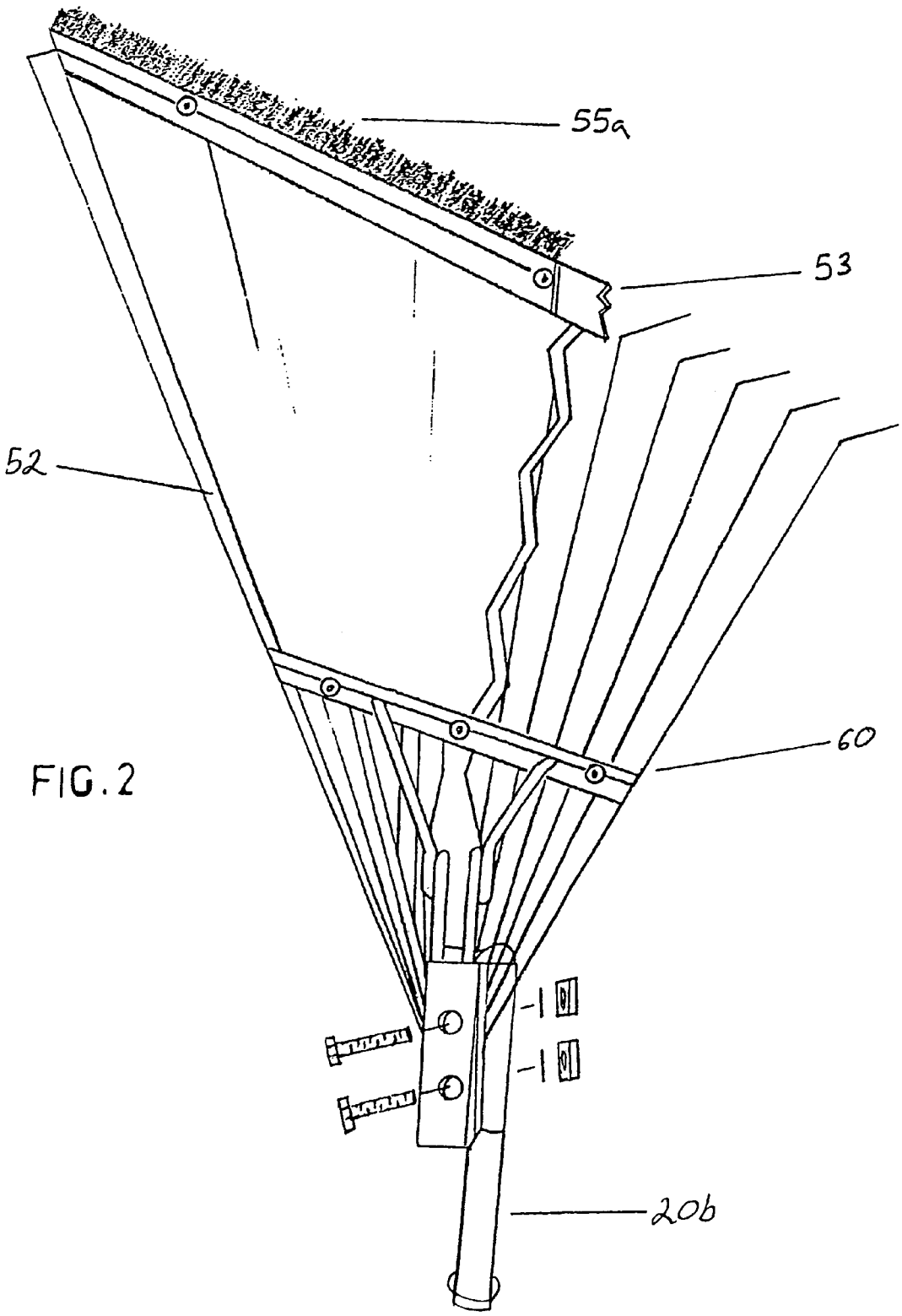
FIG. 2 is a diagram back view of a metal golf sand bunker spring rake to show a plan view of the plexiglas protective shield holding plate assembly behind the rake's teeth, with drag brush and a rubber cushion pad attached on the tool made in accordance with the invention. The protective shield holding plate assembly is to protect the rollers from hitting the rake's teeth, for illustrative purposes, part of the plate assembly is broken away to expose the rake's teeth.
Figure 3:
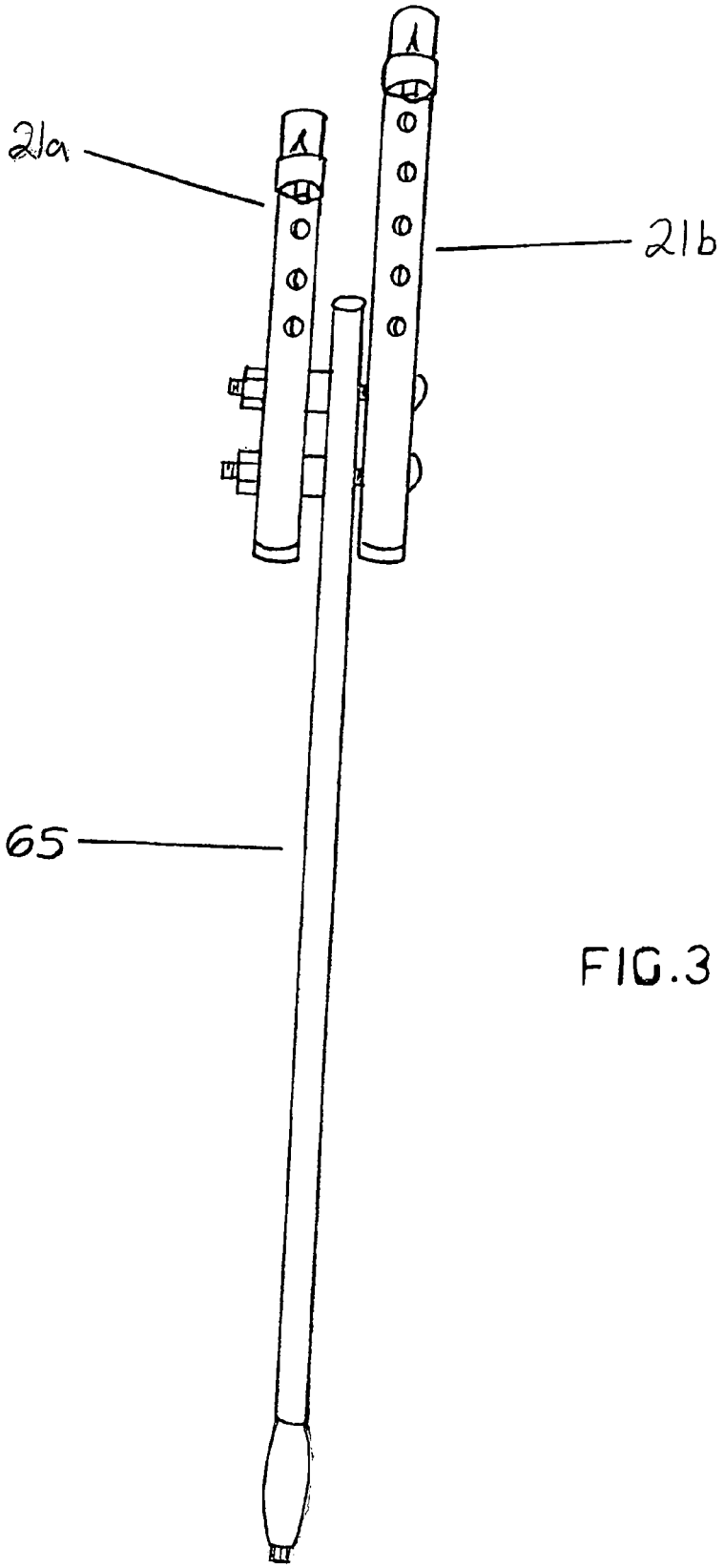
FIG. 3 is a diagram plan side view the pair of metal tubular housing with holes on the sides, showing nuts, bolts and spacers which is fastened to the rake handle made in accordance with the invention.
Figure 4:
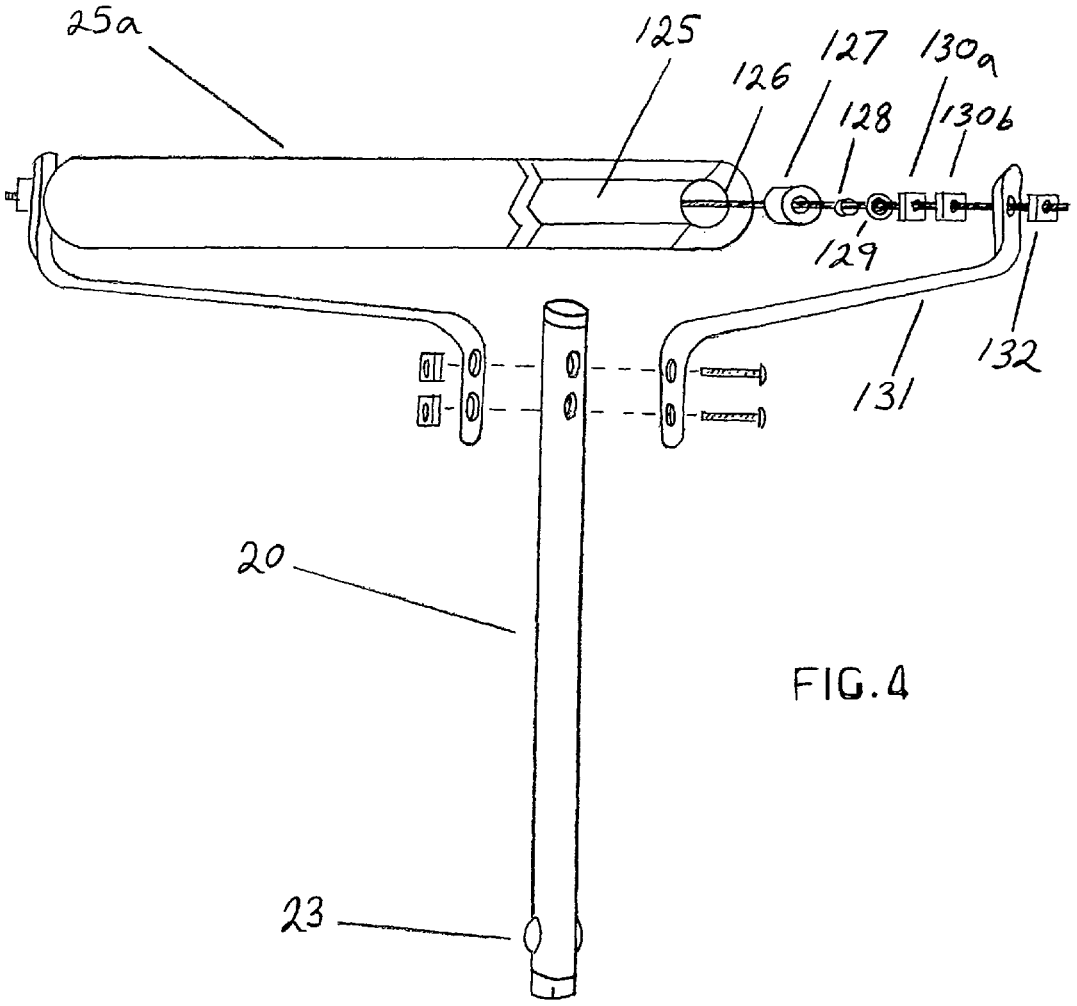
FIG. 4 is a diagram plan view of the semi soft rolling pad attachment with part of the rolling pad is broken away to show a plastic tube inside, with other components made in accordance with the invention.
Figure 5:
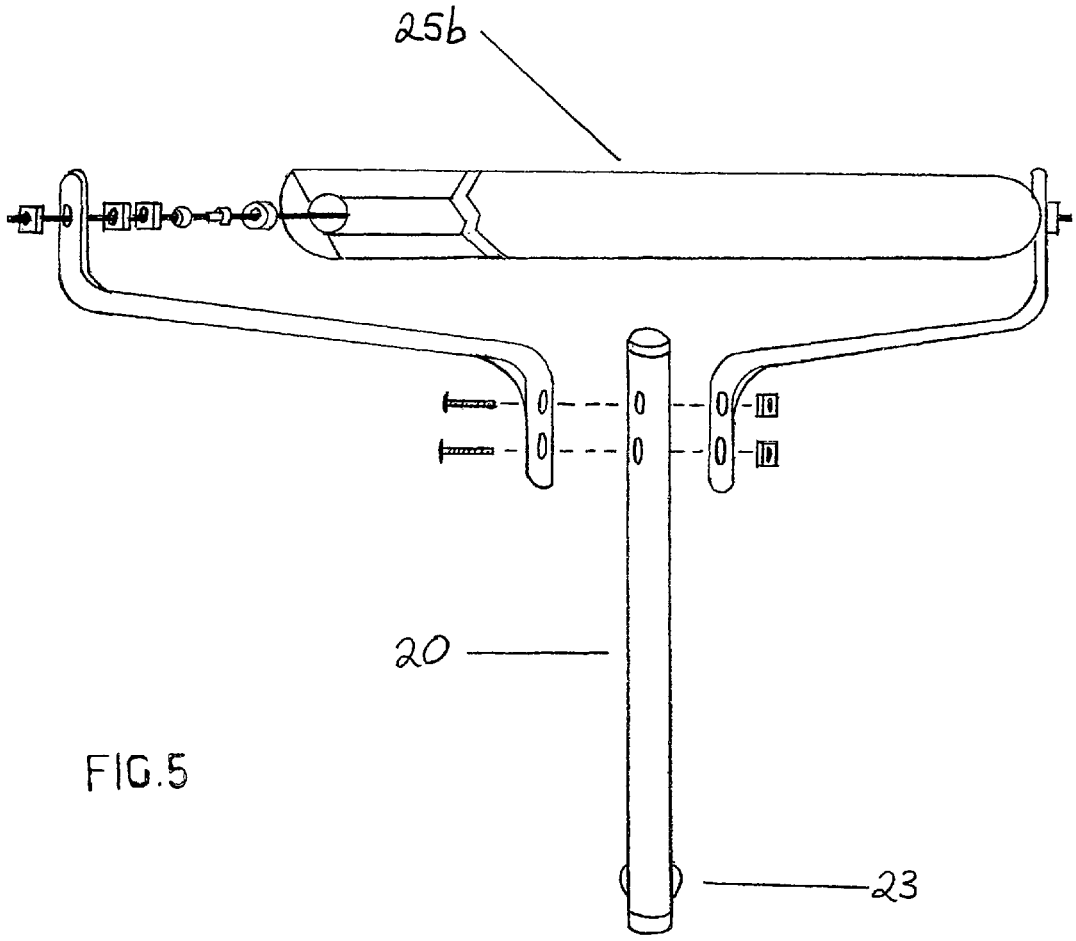
FIG. 5 is a diagram plan view of the harder rolling pad attachment with part of the rolling pad is broken away to show a plastic tube inside, with other components made in accordance with the invention.
Figure 6:
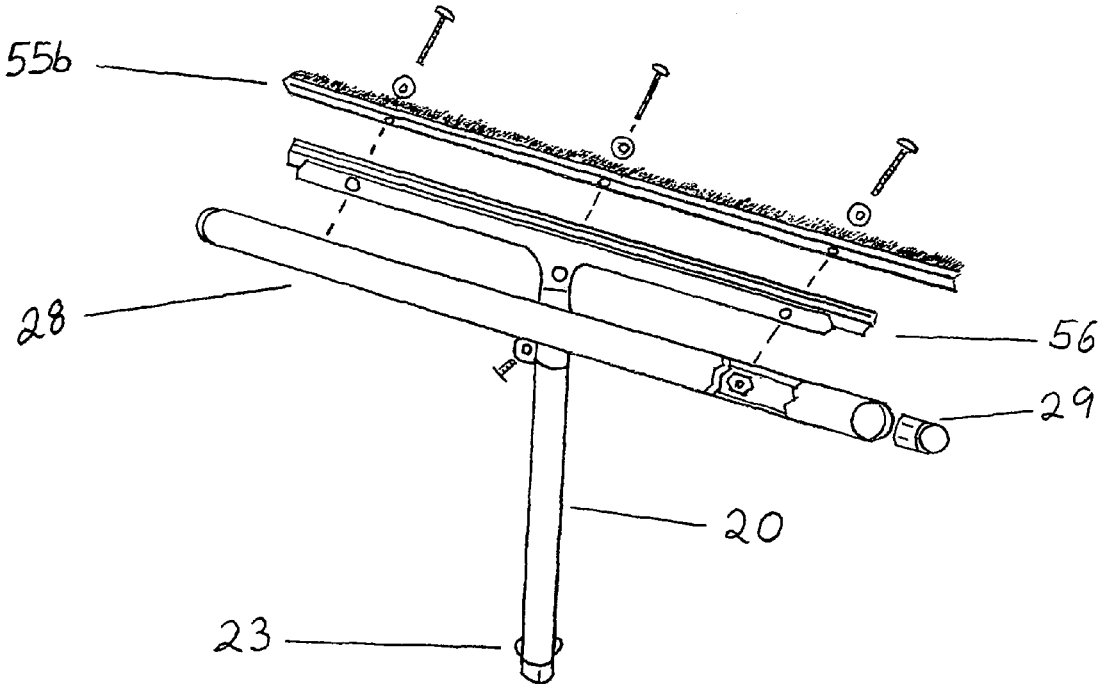
FIG. 6 is a diagram plan view of the push tube attachment assembly with a drag brush attached, with part of the push tube is broken away to show a fastened nut, with other components made in accordance with the invention.
Figure 7:
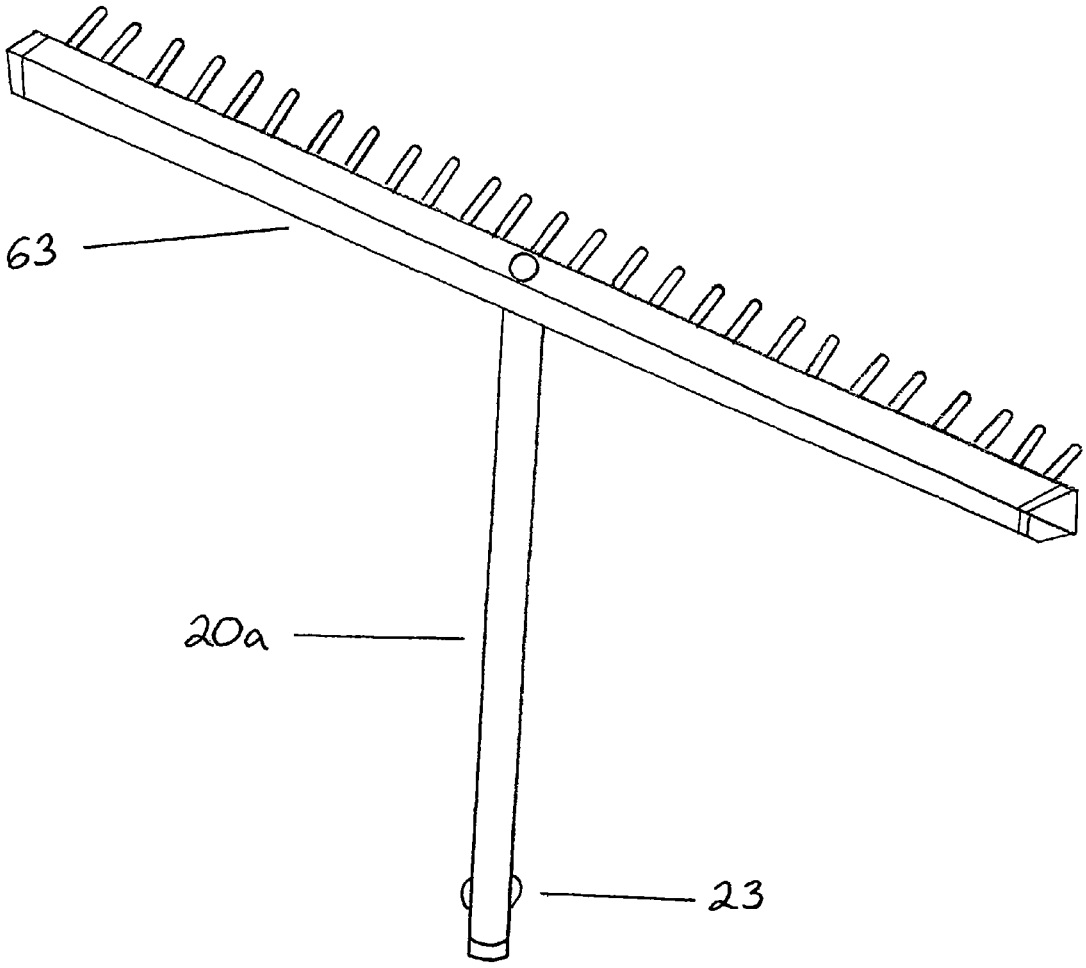
FIG. 7 is a diagram plan view of the plastic sand bunker rake attachment, with other components made in accordance with the invention.
Figure 8:
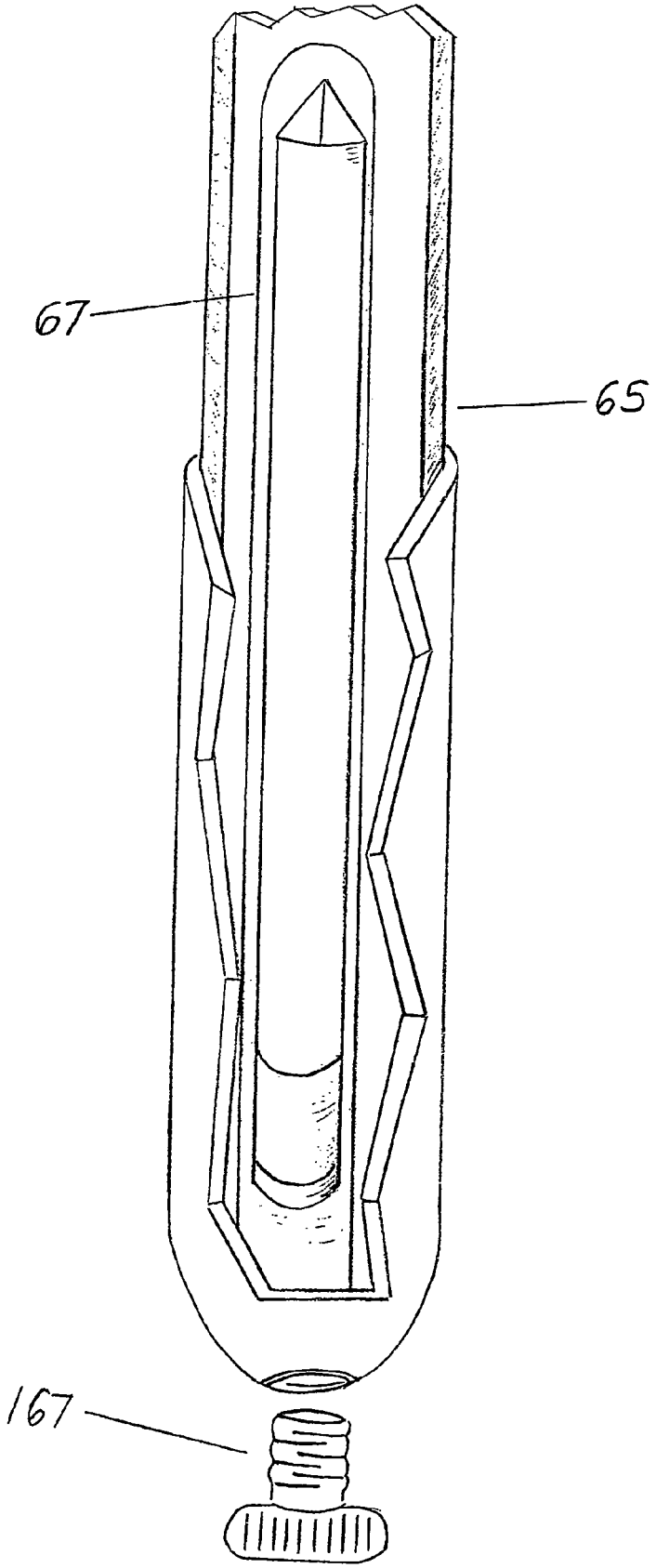
FIG. 8 is a diagram plan view of the sand probe device place inside the bottom of the handle housing with part of the handle is broken away to show the sand bunker probe device inside, with other components made in accordance with the invention.

FIG. 1-2 illustrate a first exemplary embodiment of the present invention, referred to generally as the rake 60.

As shown in FIG. 2-8 the rake 60 attachment, includes a plexiglas protective shield holding plate assembly 52, with drag brush attached 55*a*, a rubber cushion pad 53, a pair of metal tubular housing 21*a*, 21*b* attached to the rake's handle, two roller attachments 25*a*, 25*b*, a push tube attachment assembly 28, with drag brush 55*b*, a plastic sand bunker rake attachment 63, and a sand bunker probe device 67.

The rake 60 attachment is eighteen inches wide and sixteen inches long, which is attached to a five and half inches long metal pipe 20*a*, that has two squeeze buttons 23, on each side at the pipe's bottom, with a plexiglas protective shield holding plate assembly 52, with drag brush 55*a* and a rubber cushion pad 53, attached behind the rake's teeth.

The plexiglas protective shield holding plate assembly 52, with drag brush 55*a*, and a rubber cushion pad 53, is about eighteen inches wide and ten inches long, with nuts and bolts which is fastened to the rake 60, the plexglas protective shield holding plate assembly 52, is also to protect the roller attachments 25*a*, 25*b*, from hitting the rake's teeth, the golf metal sand bunker spring rake 60 attachment should only be attach to the shorter metal tubular housing 21*a*.

The handle 65, is sixty inches long with a pair of metal tubular housings 21*a*, 21*b*, attached to the handle.

The pair of metal tubular housings 21*a* and 21*b* are two different sizes, 21*a* is about nine inches long, with three adjustable setting holes, and 21*b* is about twelve inches long, with five adjustable setting holes, each hole setting is one inch apart from center, with nuts, bolts and spacers that is fastened to the rake's handle 65, that separate the pair of the metal tubular housings 21*a*, 21*b*, about three inches apart to accept all the attachments, the metal sand bunker spring rake assembly attachment 60, the roller attachments 25*a* and 25*b*, the push tube assembly attachment 28, with drag brush 55*b*, and the plastic sand bunker rake 63, that can be attached.

The roller attachment 25*a*, is about eighteen inches wide× 1½" semi soft rolling pad, with a 18"×1¼" pvc tubing 125*a*, a 20" threaded rod 126*a*, showing on one side, a 1¼" radius shielded bearing 127, a ¼" spacer 128, a washer 129, two nuts 130*a*, 130*b*, through an attachment rod 131, and a nylon nut 132, which is attached to a ten inch long metal pipe 20, that has squeeze buttons 23, on each side at the pipe's bottom.

The roller attachment 25*b* is about twenty four inches wide×1½" with a harder rolling pad, with a 24"×1¼" pvc tubing 125*b*, a 26" threaded rod 126*b*, showing on one side, a 1¼" radius shielded bearing 127 a ¼" spacer 128, a washer 129, two nuts 130*a*, 130*b*, through an attachment rod 131, and a nylon nut 132, which is attached to a ten inch long metal pipe 20, that has squeeze buttons 23, on each side at the pipe's bottom.

The push tube assembly attachment 28, with drag brush 55*b*, is about twenty four inches wide pvc tubing, with a 1¼" pvc plug 29, is assembled to a 20" long spongy housing 56, which is attached to a ten inch long metal pipe 20, that has squeeze buttons 23, on each side at the pipe's bottom.

The plastic sand bunker rake attachment 63, is about twenty four inches wide, which is attached to a ten inch long metal pipe 20, that has squeeze buttons 23, on each side at the pipe's bottom.

As noted previously, the rake 60, have been provided as a multi rake device, can change back into a normal golf metal sand bunker spring rake, by leaving the roller attachments 25*a*, or 25*b*, the push tube assembly attachment 28, and the plastic sand bunker rake attachment off the rake handle 65.

The handle 65, also has a sand bunker probe device 67, (not attached) is about seven inches long, but can extend out to twenty four inches long by holding it and pull out, the sand bunker probe device 67, come from the top of the handle's housing by unscrewing the screw 167.

The invention claimed is:

1. A multi tool apparatus for golf course sand bunkers, comprising:

an elongated handle having a pair of metal tubular housings fastened to a distal end of said handle and each housing configured for receiving a respective attachment;

a rake attachment having teeth extending to a first side and a protective shield plate on a second side thereof having a drag brush to almost eliminate lines in sand and a rubber cushion pad to muzzle sound created by the rake's teeth against the shield plate, the rake attachment being removably inserted into one of the tubular housing;

a roller attachment having a rolling pad rotatable about an axis thereof, the roller attachment being removably inserted into the other of the tubular housings, wherein the protective shield plate is configured to protect the roller attachment; and a sand bunker probe device located in a proximal end of the handle configured to measure the depth of sand in a bunker.

2. The apparatus of claim 1, wherein the roller attachment is a semi soft rolling pad, configured for creating a smooth and flat slope with no lines on a sand bunker's sloped edges.

3. The apparatus of claim 1, wherein the roller attachment is a hard rolling pad, configured for compacting a sand bunker's sloped edges.

4. The apparatus of claim 1, further comprising a push tube assembly attachment attachable to one of said tubular housings and having a drag brush configured for pushing sand back up a bunker's sloped edges, and to eliminate lines.

5. The apparatus of claim 1, further comprising a plastic sand bunker rake attachment attachable to one of said tubular housings.

* * * * *